US005974716A

United States Patent [19]

Kidd

[11] Patent Number: 5,974,716

[45] Date of Patent: Nov. 2, 1999

[54] EXTRACTOR ASSEMBLY

[76] Inventor: Russell Edward Kidd, 7434 Chilton La., Riverdale, Ga. 30296

[21] Appl. No.: 08/934,757

[22] Filed: Sep. 22, 1997

[51] Int. Cl.[6] ..... F41A 3/00

[52] U.S. Cl. ..... 42/25

[58] Field of Search ..... 42/25

[56] References Cited

U.S. PATENT DOCUMENTS

| | | | |
|---|---|---|---|
| 804,699 | 11/1905 | Benet et al. | 42/25 |
| 4,100,691 | 7/1978 | Wicklund | 42/1 |
| 4,920,676 | 5/1990 | Peters | 42/25 |

FOREIGN PATENT DOCUMENTS

| | | | |
|---|---|---|---|
| 695924 | 8/1940 | Germany | 42/25 |
| 591732 | 4/1959 | Italy | 42/25 |
| 486995 | 6/1938 | United Kingdom | 42/25 |
| 637264 | 10/1947 | United Kingdom | 42/25 |
| 2260803 | 4/1993 | United Kingdom | 42/25 |

*Primary Examiner*—Charles T. Jordan
*Assistant Examiner*—Denise J. Buckley
*Attorney, Agent, or Firm*—James W. Wallis, Jr.; Herbert M. Hanegan

[57] ABSTRACT

An improved extractor housed in the breech of a firearm for extracting a metallic cartridge case from a firearm including a U-shaped cap connected to a bore wall of the breech of the firearm; an extractor body and a biasing means for exerting tensile force on the extractor body whereby said gripping end of the extractor body is forced into a gripping relationship with the rim of a metallic cartridge case to be extracted.

5 Claims, 2 Drawing Sheets

EXTRACTOR ASSEMBLY

TECHNICAL FIELD

This invention relates generally to improvements in hand held firearms and more specifically relates to improvements in extractor-and-slide-assemblies. Typically, such assemblies include a frame mounted, movable slide assembly in which is carried, at least, a firing pin, a means for driving the firing pin, an extractor for removing a cartridge case from the chamber of the barrel of the firearm, and a means for biasing or positioning the extractor such that it will properly engage the head of the cartridge being removed. The invention will be described as it would appear in a firearm being essentially the Colt firearm known as the Model 1911 or being one of the many firearms based on the Model 1911.

BACKGROUND ART

In the art of extracting either an unfired metallic cartridge or the casing of a spent metallic cartridge from the chamber of a firearm, such as the Colt Model 1911, there are certain well known and standard means for accomplishing the task. Substantially all of the means known for extracting a cartridge, or a cartridge case, from the chamber of such a firearm comprise a slide mounted, one piece, essentially flat, spring steel extractor. Though variations can and do exist, the typical extractor will comprise an elongated spring steel body having a slot cut into its base end to accept a locking key which secures it and positions it within the firearm's slide; and, it will have a hook or claw on its forward end which is positioned and dimensioned such that it engages the rim of a cartridge case, as the said case is contained within the chamber of the firearm. When so engaged, the claw will position the head of the cartridge case substantially against the face of the breech block portion of the slide. With the cartridge case so positioned, it will be oriented such that the firing mechanism of the firearm is in alignment with the primer of the cartridge case. Upon either firing the cartridge or manually operating the slide assembly so as to simulate the cycling which occurs when the cartridge is fired, the slide is moved to its rearward position. As the slide, within which the extractor is fixed, is moved to its rear or open position, the claw of the extractor removes the cartridge or cartridge case from the chamber of the firearm and, in concert with the ejector, tosses the cartridge case free of the firearm. Upon completing its rearward travel, the slide then moves forward across a magazine containing cartridges, a new cartridge is stripped from the magazine, by the breech face of the slide assembly, and is fed into the chamber of the firearm. As the cartridge is fed into the chamber of the firearm, the hook of the extractor engages the rim of the newly chambered cartridge and the cycle can be repeated.

Engaging the rim of the newly chambered cartridge, by the extractor, is accomplished in one of two ways. Ideally, as the breech face of the slide strips a cartridge from the firearm's magazine, the cartridge enters the chamber of the firearm in such a way that the rim of the head of the cartridge pivots into position between the breech face of the slide and the inner surface of the hook of the extractor. It should be obvious that when the rim of the cartridge case head is so engaged by the extractor, the extractor undergoes substantially no flexing or destructive stresses. However, there are occasions when the rim of the cartridge head is not engaged by the extractor in the above manner. It is not uncommon for a cartridge being stripped from a firearm's magazine to enter freely and substantially straight into the chamber of the firearm, pushed by the flat nose or beveled surface of the extractor body, where it continues to move forward to its battery position resulting in the extractor having to ride over the rear of the rim of the head of the cartridge case before it engages the rim. Though not the ideal, his occurrence is so commonplace that the front of the extractor is configured to ride over the rear of the rim of the head of the cartridge case so that it can, upon the slide seating into battery, properly engage the rim.

When extractors are of the above typical configuration, the process of forcing the extractor hook to ride or jump over the outside of the rim of the cartridge case flexes and stresses the spring body of the extractor. This flexing exceeds acceptable flexing limits of the typical extractor and results in a deformed extractor. As the extractor is so deformed, it becomes incapable of reliably performing its intended function. In handguns used for protection or competition, failure of an extractor to function is potentially catastrophic.

Presently, the fix for an extractor that no longer functions is to replace it with a new and identical extractor. However, it should be obvious that the replaced extractor will soon suffer the same fate as its predecessor. The basic design of the Colt Model 1911 type extractor has remained essentially unchanged since its introduction in 1911. The only way to truly correct the inherent problems associated with the extractor is to replace it with an extractor which relies on a different tensioning system. The use of coil springs to bias an extractor has been proven reliable through the years.

U.S. Pat. No. 2,421,249 teaches a coil spring biased plunger acting on a cartridge-extractor body having a small hook for engaging the cartridge casing. The assembly is contained within a series of intricate and multi-positioned cavities within the bolt assembly of the firearm being described. The assembly is more clearly indicated and described in FIG. 3. of the printed patent.

U.S. Pat. No. 3,090,148 also teaches a similar system for extracting a cartridge. However, it too relies on a multitude of cavities and interdependent elements to perform its function. This assembly is more clearly indicated and described in FIG. 21 of the printed patent.

U.S. Pat. No. 3,142,923 again teaches a coil spring biased extractor assembly. Again, it is an exceptionally complex system of cavities and small interdependent elements. This assembly is clearly shown in FIG. 6 of the printed patent.

From the above references, it is clear that extractors embodying hooks or claws biased by coil springs are known and used in the industry. It should also be clear that the complexity of the extractor assemblies would make it virtually impossible to add them as an after-market addition to existing firearms. Even if there were sufficient room in a slide assembly to install such extractor assemblies, the costs of re-machining for such an adaptation would be extremely expensive. In order to be economically practical, a firearm would need to be designed and manufactured with such an extractor assembly. When extractors having such a design are incorporated into the process as a firearm is being manufactured, the costs of the intricate machining required for installation of the parts, though not eliminated, are at least minimized.

It is the need for a simple, inexpensive, absolutely reliable extractor that is addressed by the present invention.

DISCLOSURE OF THE INVENTION

It is therefore a primary object of the present invention to provide an improved extractor for firearms having extractors similar to those found on firearms such as the Colt Model 1911 type.

It is a further object of the present invention to provide an extractor biased by a coil spring or springs and which itself can flex in a springlike manner and which exhibits an improved reliability and use life.

It is also an object of the present invention to provide an apparatus to replace the extractor of the kind typically associated with a Colt Model 1911 type firearm, without the necessity of performing intricate machining operations on the slide of such firearm in order to adapt it to such an extractor.

It is further an object of the present invention to provide an inexpensive, coil spring biased extractor assembly that can be directly substituted for the standard, flat, solid spring extractor typically found in a Colt Model 1911 type firearm.

And still a further object of the present invention is to provide an extractor having a configuration such that the extractor itself can provide some degree of biasing by being flexed itself when riding over a cartridge rim.

The principal feature of the present invention is an assembly containing all of the parts necessary to provide a reliable, long lasting, replacement for the standard solid spring extractor typically found on a Colt Model 1911 type firearm.

Another feature of the present invention is the use of simple coil springs to assist in biasing the extractor.

Still another feature of the present invention is an assembly that can be directly inserted into the unmodified cavity which houses the standard extractor typically found in the slide assembly on a Colt Model 1911 type firearm.

The main advantage of the present invention is it provides a reliable, inexpensive and quick replacement for the solid, flat standard spring extractor typically found on a Colt Model 1911 type firearm.

In accordance with these and other objects, features, and advantages, there is provided a coil spring biased extractor assembly which is dimensioned such that it can be inserted directly into the cavity housing the standard, flat spring extractor typically found on a Colt Model 1911 type firearm and which will provide positive, reliable extraction of cartridge cases.

BEST MODE OF CARRYING OUT THE INVENTION

Figure 1:
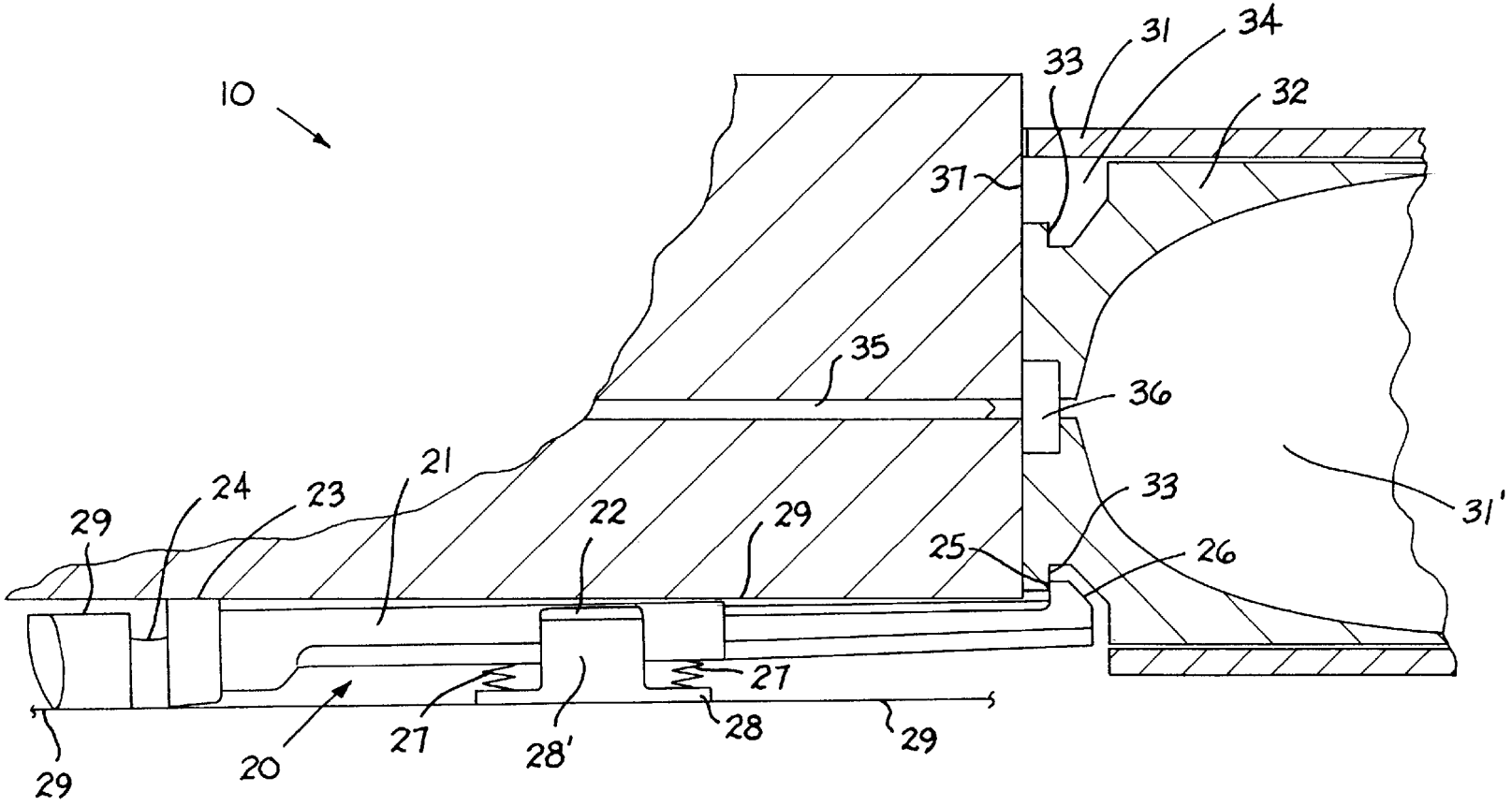
FIG. 1 is a top cutaway sectional representation of the present invention depicting: that portion of the slide assembly into which is mounted a firing pin; the body and biasing means of the extractor member of the present invention; and the chamber portion of the barrel of the firearm wherein is contained the cartridge case and the special relationships between the various elements.

Refer now to FIG. 1, which is a top cutaway sectional representation of the present invention depicting a portion of the slidably mounted slide assembly 10 comprising: that portion of slide assembly 10 into which is mounted a firing pin 35; that portion of slide assembly 10 into which is mounted the body 21 and biasing means 27 of the extractor member 20 of the present invention; the chamber portion of barrel 31 of the firearm wherein is contained cartridge case 32; and the special relationships between the various elements contained therein.

In the typical and desirable sequence of feeding and seating cartridge 32 within barrel 31 of a firearm, as slidably mounted slide assembly 10 is retracted to its rearward most position and released to move forward, the breech face 37 of assembly 10 strips cartridge 32 from a source of cartridges (not shown), the same typically being a removable cartridge clip assembly (not shown). As cartridge 32 is driven forward and removed from a removable cartridge clip assembly (not shown) by the action of face 37 of assembly 10, cartridge 32 enters the chamber end of barrel 31 and pivots into an axial alignment with the chamber within bore 31' of barrel 31. As cartridge 32 is pivoted into position and aligned with bore 31' of barrel 31, its rim 33 slides into position between face 37 of assembly 10 and hook face 25 of extractor body 21 of extractor assembly 20. Body 21 is held in position by the action of springs 27 compressed between body 21 and spring cap 28 which in turn acts on the bore surface 29 of slide assembly 10 in which are contained assembly 20.

Still referring to FIG. 1, a second and less desirable sequence of seating cartridge 32 within barrel 31 of a firearm can occur. In such an event, as slidably mounted slide assembly 10 is retracted to its rearward most position and released to move forward, the breech face 37 of assembly 10 strips cartridge 32 from a source of cartridges (not shown), the same typically being a removable cartridge clip assembly (not shown). As cartridge 32 is driven forward and removed from a removable cartridge clip assembly (not shown) by the action of face 37 of assembly 10, cartridge 32 enters the chamber end of barrel 31 substantially in an axial alignment with the chamber within bore 31' of barrel 31. As cartridge 32 is seated into position already substantially aligned with bore 31 of barrel 31, its rim 33 is positioned directly in front of beveled face 26 and not between face 37 of assembly 10 and hook face 25 of extractor body 21 of extractor assembly 20 as in the above described desirable sequence. As beveled face 26 of body 21 of assembly 20 is driven onto rim 33 of cartridge 32, beveled face 26 rides over rim 33 until hook face 25 clears rim 33 and is seated into position such that rim 33 of cartridge 32 is now held securely between face 37 of assembly 10 and hook face 25 of body 21 of assembly 20, in the same fashion as described above in the desired sequence description. As beveled face 26 rides over rim 33, extractor body 21 pivots about body surface 23 within bore wall 29. Body 21 is secured within the bore defined by wall 29 by means of a retainer (not shown) acting in cooperation with locking groove 24.

In either event as described above, when next the slidably mounted slide is moved in a rearward direction, hook face 26 acts on rim 33 of cartridge 32 so as to remove cartridge 32 from the chamber of barrel 31. Hook face 25 is positioned against rim 33 by the action of springs 27. Portions of springs 27 are contained within spring retaining cavities (see FIG. 3.). Saddle portion 28' of spring cap 28 straddles seating portion 22 of body 21 maintaining alignment among the elements. With springs 27 being contained within spring containing cavities (see FIG. 3.), and between body 21 and spring cap 28, and with spring cap straddling body 21 at seating portion 22, springs 27 are compressed. With the elements of extractor assembly 20 being so configured and placed within the bore defined by wall 29, both body 21 and cap 28 are tensioned in opposite directions within bore defined by wall 29. Spring cap 28 is dimensioned such that when it is contained within the bore defined by wall 29, it is essentially and substantially of bore diameter and does not move to any substantial degree when tensioned as above. However, being so tensioned, hook face 25 is biased so as to engage rim 33 as hook face 25 exceeds confinement by exiting bore defined by wall 29. Extractor body 21 pivots about bearing surface 23 when hook end of body 21 moves out of bore defined by wall 29 and engages rim 33. A firing pin stop means (not shown) is typically utilized as a means for securing or locking extractor body 21 in the bore defined by wall 29. The tolerance of fit between locking groove 24 of extractor body 21 and firing pin stop means (not shown) provides additional rigidity or lack thereof of assembly 20 as it is contained within the bore defined by wall 29.

Modifications to the manufacture of some of the elements of the extractor assembly have been shown to result in unexpected, and but very desirable, results. Springs 27 can be configured so that they resist compression to a greater degree than body 21 of assembly 20 resists flexing. When so configured, as tapered face 26 rides over rim 33, body 21 flexes such that it (body 21) combines some flexing with its rotation about surface 23. The advantage thereto is that over time, surface 23 acting within the bore defined by wall 29, is not abraded to the degree as when body 21 flexes little or none and all of the movement of face 26 in riding over rim 33 is accomplished by pivoting about surface 23 within the bore defined by surface 29. With body 21 configured and tempered to withstand some flexing, the use life of the extractor assembly is greatly increased.

Figure 2:
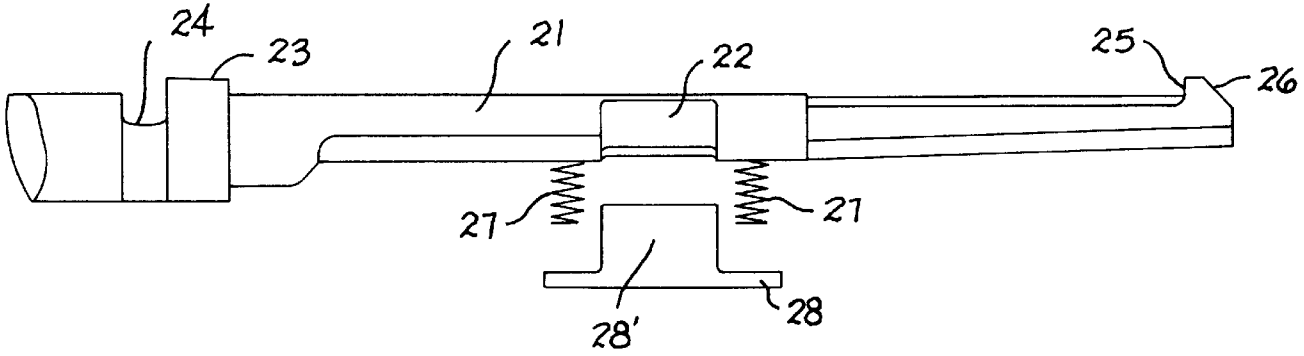
FIG. 2 is a general illustration of the extractor assembly including the body and its associated elements, springs, and spring cap.

Refer now to FIG. 2 which is a general illustration of the extractor assembly including the body and its associated elements, springs, and spring cap. Spring cap 28 is configured such that springs 27 are nested in spring retaining recesses 27' and are compressed when cap 28 is seated on seating portion 22 of extractor body 21.

Figure 3:
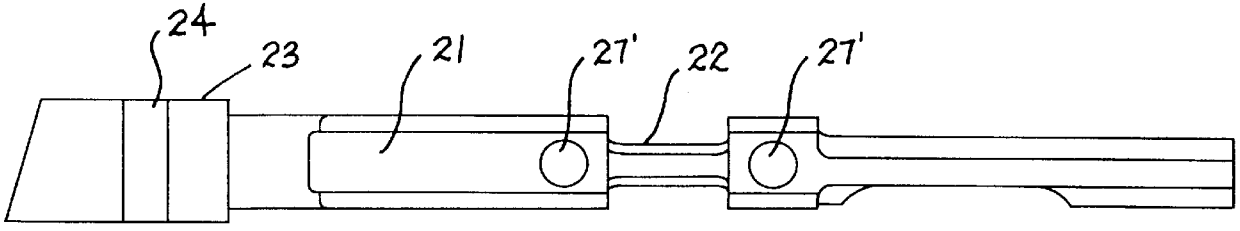
FIG. 3 is a general illustration of the body of the extractor showing the recesses in which the springs nest.

Refer now to FIG. 3 which is a view of the body of the extractor showing the recesses 27' in which the springs nest. Springs 27 (see FIG. 2) nest within spring retaining recesses 27'. Recesses 27' provide a means to position springs 27 such that they stay positioned within bore defined by surface 29.

Figure 4:
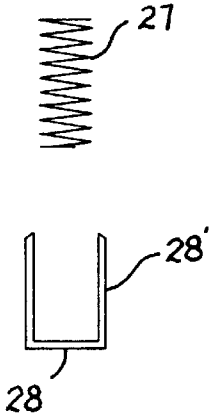
FIG. 4 is an end view of the spring and spring cap which shows the configuration of the cap as it would straddle the extractor body.

Refer now to FIG. 4 is an end view of the spring and spring cap which shows the configuration of the cap as it would straddle the extractor body. Spring cap 28 is dimensioned such that it straddles seating portion 22 of body 21. Legs 28' of spring cap 28 cooperate with seating portion 22 of body 21 to properly position body 21, springs 27, and spring cap 28 of assembly 20.

Although the invention has been discussed and described with primary emphasis on one embodiment, it should be obvious that adaptations and modifications can be made for other systems without departing from the spirit and scope of the invention.

What is claimed is:

1. An improved extractor housed in the breech of a firearm for extracting a metallic cartridge case, said case having a rim for gripping the case from the chamber of the firearm, comprising:

a U-shaped cap connected to a bore wall of the breech of the firearm;

an extractor body having a locking end, a gripping end, and a seating portion between said locking end and gripping end whereby said cap straddles the seating portion to maintain alignment of the extractor body;

biasing means for exerting tensile force on the extractor body whereby said gripping end of the extractor body is forced into a gripping relationship with the rim of the metallic cartridge case; and securing means for attaching said biasing means to the extractor body.

2. The extractor of claim 1, wherein said biasing means is at least one spring.

3. The extractor of claim 2, wherein said spring is a coil spring.

4. The extractor of claim 1, wherein the securing means is one or more cavities in the extractor body for attaching the biasing means.

5. The extractor of claim 2, wherein the securing means is one or more cavities in the extractor body for attaching one or more springs, said cavities being equal in number to the number of springs.

* * * * *